United States Patent [19]

Hoffmeister et al.

[11] 4,066,248

[45] Jan. 3, 1978

[54] CHARGING DEVICE

[75] Inventors: Bernhard Hoffmeister; Wilhelm Schwarz, both of Wilhelmshaven, Germany

[73] Assignee: Fried. Krupp Gesellschaft mit beschrankter Haftung, Essen, Germany

[21] Appl. No.: 750,528

[22] Filed: Dec. 14, 1976

[30] Foreign Application Priority Data

Feb. 27, 1976 Germany ..... 2607947

[51] Int. Cl.[2] ..... C22B 9/10

[52] U.S. Cl. ..... 266/216

[58] Field of Search ..... 266/216; 75/53–58, 75/61

[56] References Cited

U.S. PATENT DOCUMENTS 3,729,309 4/1973 Kawawa ..... 75/53

3,871,870 3/1975 Nemoto et al. ..... 75/53

FOREIGN PATENT DOCUMENTS 850,235 9/1952 Germany ..... 266/228

*Primary Examiner*—Gerald A. Dost

*Attorney, Agent, or Firm*—Walter Becker

[57] ABSTRACT

A charging device, especially for supplying aluminum in the form of wire to a steel melt for quieting the melt, in which a frame positioned adjacent the melt vessel has an inclined wall on the side facing the melt and a boom slidable along the inclined wall contains feed rollers for feeding a wire through a feed tube toward the melt. The wire is derived from a reel supported in the frame with the reel being driven in payout direction. The wire is cut off at the lower end of the feed tube and is dropped into the melt together with a combustible guide sleeve which is releasably clamped to the feed tube.

9 Claims, 3 Drawing Figures

CHARGING DEVICE

The present invention relates to a device for charging a steel melt to be quieted with aluminum. It is known, for quieting steel melt, manually to introduce aluminum rods or blocks into the steel melt. In this connection, the aluminum rods are bundled for instance by means of a steel ring, and by means of a handle bar welded to the steel ring, the aluminum bundle is immersed into the steel melt. The deep immersion of the aluminum bundle into the steel melt brings about the required good intermixture of the aluminum with the steel melt. In this connection, the buoyancy of the steel melt has to be overcome.

Another heretofore known procedure of the type involved consists in that aluminum blocks are thrown into the steel melt which blocks are then by means of suitable steel rods pressed below the surface of the steel melt.

The manually carried out operations place a high physical as well as psychological stress upon the operating personnel, especially in view of the heat radiation from the steel melt and the sparks therefrom flying around. During the relatively slow passing of aluminum through the surface of the steel melt, an undesired strong oxidation occurs which reduces the quality of the steel melt.

It is, therefore, an object of the present invention to provide a device for charging a steel melt to be quieted with aluminum, while replacing the heretofore customary manual charging operation by a mechanized charging operation.

It is another object of the invention to simplify and improve the charging operation as well as realizing an improvement in the quality of the steel melt. It is still another object of this invention to provide a device as set forth in the preceding paragraphs, by means of which the oxidation during the passing of aluminum through the surface of the steel melt, and the effect of the heat radiation as well as of the flying sparks from the steel melt onto the servicing personnal will be prevented.

These and other objects and advantages of the invention will appear more clearly from the following specification in connection with the accompanying drawings, in which.

Figure 3:
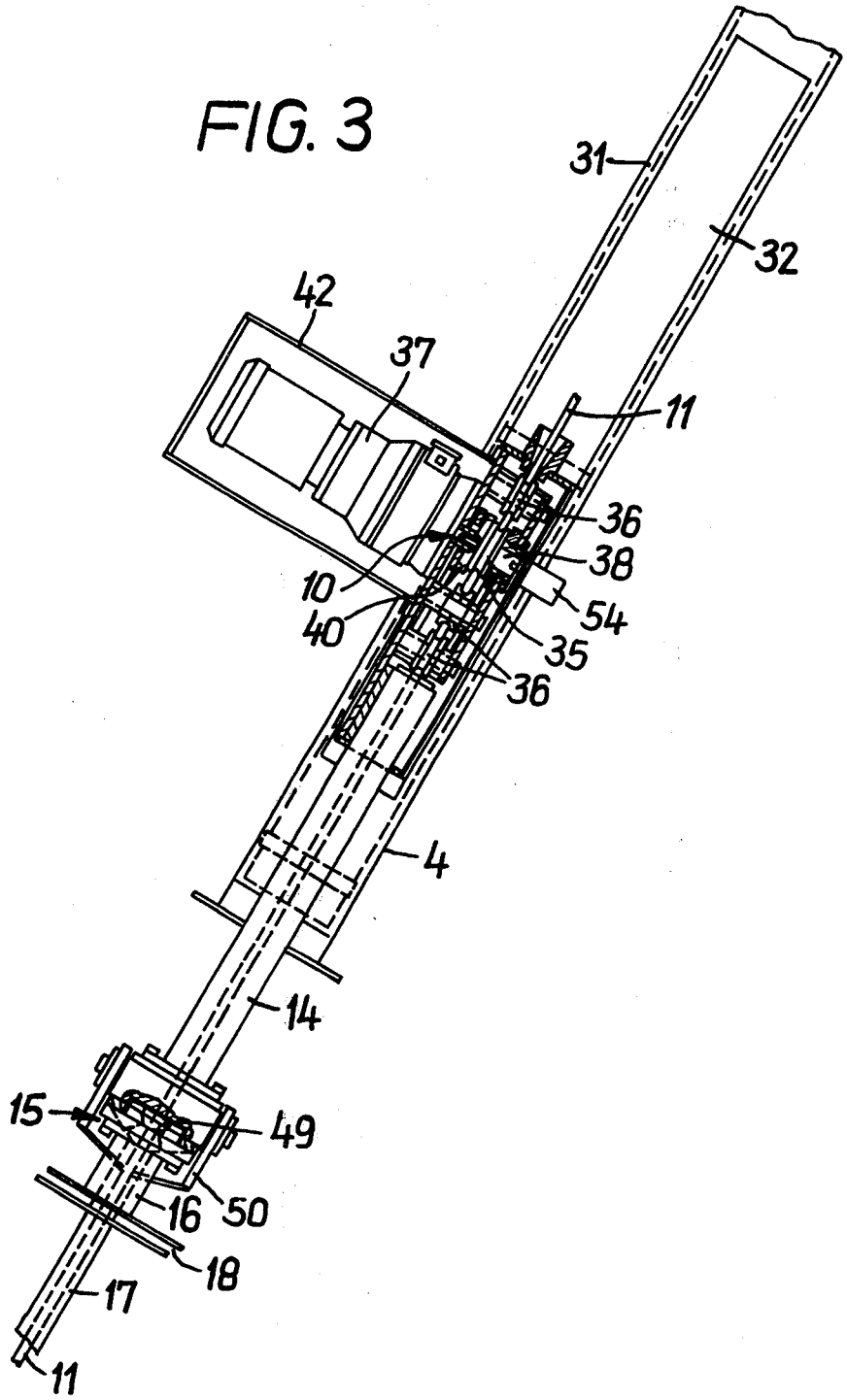

FIG. 3 is a front view of the transporting device for the aluminum wire of the feeding pipe of the wire shearing device, of the clamping and releasing device and of the protective shield The device according to the present invention is characterized primarily in that it includes a roll having wound thereon an aluminum wire, and furthermore comprises a transporting device for the aluminum wire being wound off said roll, and also comprises a feeding pipe for introducing the aluminum wire into the steel melt. In this way, it will be assured that a mechanical charging device takes over the heretofore manually carried out charging operation in the aluminum wire which is wound onto the rotatably journalled roll or reel serves as so-called endless wire for rationalizing the charging operation. The transporting device conveys the aluminum wire through the feeding pipe in a continuous manner and quickly into the steel melt.

It is advantageous to journal the roll having aluminum wire wound thereon on a roll support which is fastened to a rotatably journalled plate. The roll support is equipped with a driving system according to which an electric motor through the intervention of a drive shaft drives the roll at the mantle surface of the aluminum wire coil because this driving system will at a constant speed of the electric motor and a varying winding diameter continuously feed the same wire length and will thus permit a precise metering of the charging weight and its uniform and proper insertion into the steel melt.

According to an advantageous further development of the invention, the transporting device for the aluminum wire is arranged in a box-shaped boom which is displaceable relative to an upper structure in the direction of the wire movement, said upper structure being fastened to the plate. According to said further development of the invention, it is also suggested that the wire transport is effected by means of a stepless controllable electric motor transmission unit through the intervention of driving grooved rolls arranged in pairs and by means of the additional guiding rolls arranged in pairs and forming with said first mentioned driving rolls a rectilinear guiding arrangement for the aluminum wire. The control of the feeding speed at which the aluminum wire moves in the steel melt will in view of the stepless controllable electric motor driving unit bring about that the melting process of the aluminum wire is finished only shortly prior to reaching the bottom of the crucible or melting pan. A very satisfactory intermixture and quieting reaching down in depth of the steel melt is therefore assured.

A proper wire transport will be assured by two driving grooved rolls which are arranged on a pair of levers which is journalled on one of the axles of said two last mentioned rolls, and by a pressure spring acting upon one lever end which spring brings about a deviation of aluminum wire from the straight guiding path whereby a frictional connection is established between said driving rolls and the aluminum wire. In this way, in case of variations in the diameter of the aluminum wire, a permanent frictional connection is brought about by the least deformation work of the aluminum wire.

In an expedient manner, the aluminum wire is from the reel along a wide arc passed to the driving grooved rolls which arc has a compensating function when the circumferential speed of the reel should vary or should briefly deviate from the speed of the driving grooved roll. The control of the transporting speed of the aluminum wire when entering the steel melt and when winding off said reel is so effected that after a charging cycle, the wide arc of the aluminum wire will always again have the same size. Revolution counters respectively arranged on a driving grooved roll and on the driving shaft ascertain the respective wire length. The said arc will permit an adaptation of the circumferential speeds of the winding mantle and driving grooved rolls to each other within a charging operation and will thus prevent a tearing-off or breaking off of the aluminum wire.

Expediently, for introducing the aluminum wire into the steel melt the feeding pipe which is connected to the lower end of the boom feeds the aluminum wire at an incline of 60° with regard to the surface of the steel melt onto and into the steel melt.

It is furthermore recommended according to the invention that at the lower end of the feeding pipe there are provided a wire shearing device with a displaceable knife or blade which is driven by a power operable device arranged in the boom, for cutting off the aluminum wire, and a clamping and loosening device for a cardboard sleeve bridging the space between the lower end of the feeding pipe and in the direction of movement of the aluminum wire behind the driving grooved rolls makes a re-introduction of the aluminum wire into the driving grooved rolls after each charging cycle superfluous. The cardboard sleeve which is clamped in at the lower end of the feeding pipe and bridges the spacing with regard to the steel melt keeps away the oxygen of the air from the aluminum wire when the latter passes through the surface of the steel melt. The oxidation of the aluminum wire at the surface of the steel melt will be prevented.

It is furthermore advantageous between the wire shearing device and the clamping and loosening device to provide a mechanical forced connection. In such an instance, only a single power operable device is required for the wire shearing device and for the clamping and loosening device.

Expediently, the displacement of the boom is effected by guiding rods and a power operable displacing device which are located in the upper structure. In this way, it is possible in a very simple manner to adjust the proper location of the inlet spot of the aluminum wire and the most appropriate distance with regard to the steel melt.

For purposes of protection against flying sparks from the steel melt, the boom is inserted in a spring steel band which is passed over cylindrical rollers located in the corners of said upper structure. Said boom is furthermore under the tension of springs, and vents the opening in the upper structure which opening determines the displacement path of the boom.

According to a further development of the invention, a servicing device is arranged on the plate. This servicing device comprises a heat-protective window, and a servicing seat with servicing levers and instruments. The heat protective window protects the operator against heat radiation coming from the steel melt and against flying sparks.

Referring now to the drawings in detail, the charging device comprises a stationary base plate 1 having rotatably mounted thereon a housing 2. The housing 2 comprises a plate 3 and a box-shaped upper structure 4. The discharging device comprises laterally of the structure 4 a roll or reel support 5, and a servicing device 6 which is located opposite the support 5 and laterally of the structure 4. The structure 4 has an inclined end face 7 and is provided with a closed box-shaped boom 9 which is displaceable in the longitudinal direction 8 of the inclined end face 7. The boom 9 is equipped with a transporting device 10 for aluminum wire 11 and with a hydraulic power operable device 12 for the displaceable cutting blade 13. At the bottom side of the boom 9 there is provided a double walled feeding pipe 14. The longitudinal axis of the feeding pipe 14 and the longitudinal direction 8 of the inclined end face 7 are parallel to each other. The feeding pipe 14 has its lower end provided with a wire shearing device 15, and comprises a clamping and loosening device 16 adapted to receive a thick-walled tubular cardboard sleeve 17, and is furthermore provided with a double-walled protective shield 18.

A motor driving unit 19 through a ring 20 brings about a rotary movement of the housing 2. The motor driving unit 19 is connected to the structure 4 on plate 3.

Arranged on the reel support 5 is a reel 21 which has aluminum wire 11 wound thereon. The support 5 is furthermore provided with a pivotable spring loaded driving shaft 22 which consists of soft rubber or synthetic material, and the longitudinal axis of which extends parallel to the longitudinal axis of the reel 21. A rotary drive for the driving shaft 22 is effected through the intervention of its flanks by means of an electric motor 23. The spring load of the driving shaft 22 brings about a frictional connection of its mantle with the aluminum wire coil 24 and thus a reeling off of the aluminum wire 11. In case of a variable winding diameter, the rotary drive will at constant speed of the electric motor 23 assure a uniform delivery of the wire length per time unit.

For the servicing device 6 there is provided a servicing seat 25 with levers and indicating instruments as well as a heat protective window 26 for protecting an operator against heat radiation and flying sparks.

In the structure 4 for the boom 9 there is provided a displacing device 27 which acts in the longitudinal direction 8 of the end face 7. To this end, a pair of guiding rods 28 with cylindrical slideable ball bushings 29 and a hydraulic or pneumatic displacing device 30 are provided in the guiding rods 28 and are connected to the structure 4 whereas the ball bushings 29 are connected to the boom 9. The power operable displacing device 30 is arranged between the structure 4 and the boom 9.

The end face 7 has an opening 31 which permits the displacing movement of the boom 9. The opening 31 is by means of a spring steel band 32 shielded against dust and flying sparks, said band 32 being screwed to the boom 8. The spring steel band 32 is passed over four cylindrical rolls 33 located in the corners of the structure 4. Said band 32 is tensioned by springs 34.

Arranged in the boom 9 are the transporting device 10 for the aluminum wire 11 and the hydraulic power operable device 12 for the wire shearing device 15, said hydraulic power operable device 12 being in operative connection with the clamping and loosening device 16.

For the transport of the aluminum wire there are respectively arranged pairs of driving grooved rolls 35 with a drive and with guiding rolls 36. The drive of a journalled driving grooved rool 35 is effected by an infinitely variable electric motor driving unit 37 about its rotatable driving axle 38.

The driving grooved rolls 35 provided with follower notches are in a fixed space arrangement to each other supported by a pair of levers 39 which in its turn is journalled about the driving axle 38. Both rools 35 are equipped with gears 40 meshing with each other and thus with opposite direction of rotation exert a transporting effect upon the aluminum wire 11. The guiding rolls 36 journalled on the boom 9 together with the driving grooved rolls 35 form a rectilinear passage. A pressure spring 41 arranged on the lever pair 39 counteracts the straight guiding of the aluminum wire 11 and thus generates the pressing-on pressure for the frictional connection between the aluminum wire 11 and the driving grooved rolls 35.

The electric motor driving unit 37 is arranged in a cylindrical protective mantle 42 which is screwed onto the boom 9. For purposes of withdrawing the current heat of the electric motor driving unit 37 and for protection against radiation heat from a crucible arranged below the charging device and containing steel melt 43 there is provided a further ventilation system. The air to be discharged is passed through the interior of the boom 9 and the feeding pipe 14 and escapes through a bore 44 at the lower end of the feeding pipe 14. This will also assure a cooling of the feeding pipe 14. The feeding pipe 14 is located at the bottom side of the boom 9 and has a double wall. An inner pipe 45 serves as guiding passage for the aluminum wire 11 while the outer pipe 46 brings about the necessary stiffness of the feeding pipe 14.

The feeding pipe 14 has its lower end provided with the wire shearing device 15 together with the clamping and loosening device 16 connected thereto and the double walled protective shield 18.

For the wire shearing device, the displaceable cutting blade 13 has a hole cutting edge opposite to which there is provided a stationary blade 47 with a hole cutting edge. The displaceable cutting blade 13 is provided with a leaf spring 48 which is fastened to the lower end of the feeding pipe 14. A displacement of the blade 13 relative to the blade 47 and against the pressure of the leaf spring 48 is effected by means of a nose roller 49 aided by the power operable device 12 which through the intervention of a joint lever 50 is in communication with said roller 49.

Figure 1:
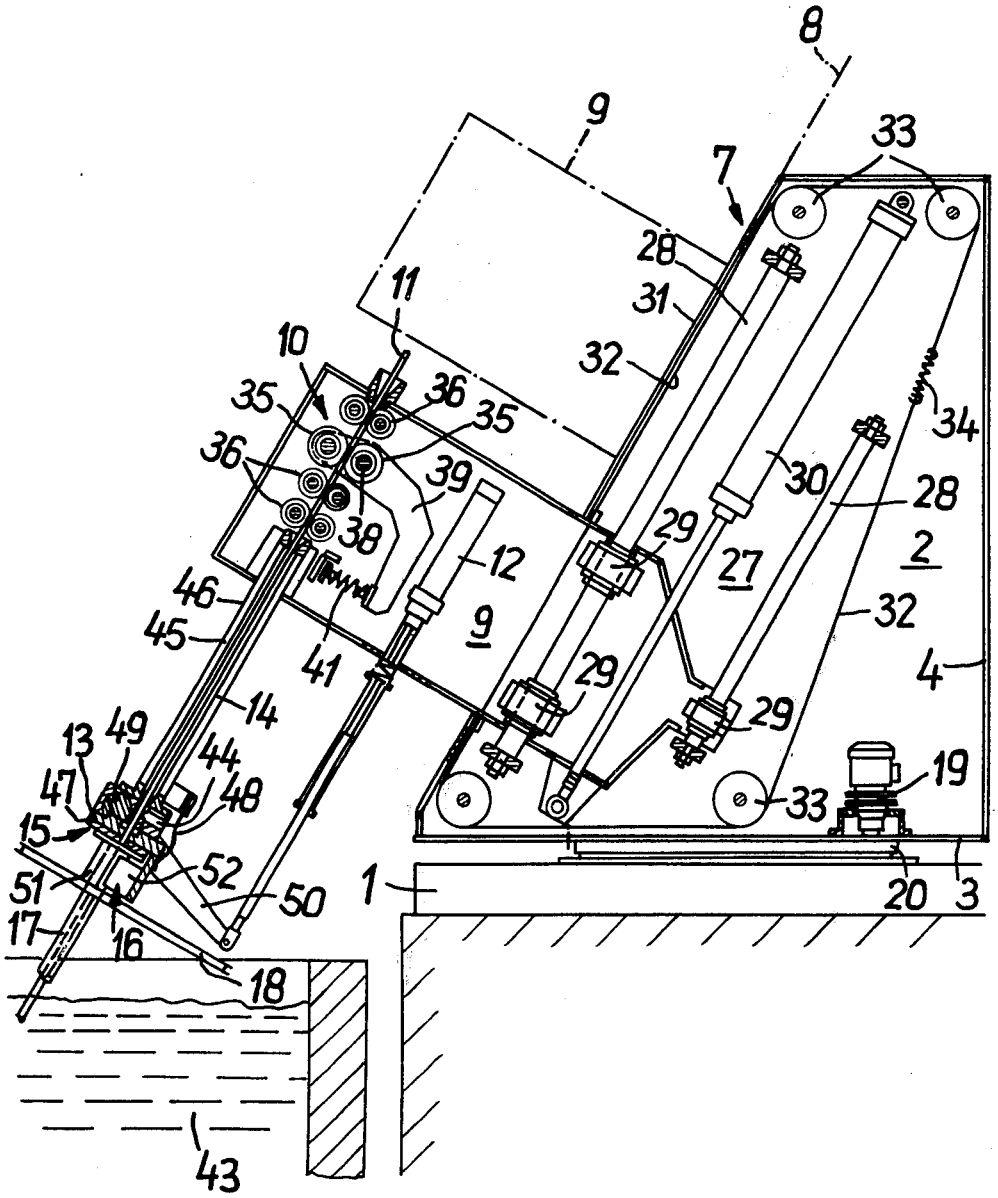
FIG. 1 is a side view of a charging device according to the invention.
Figure 2:
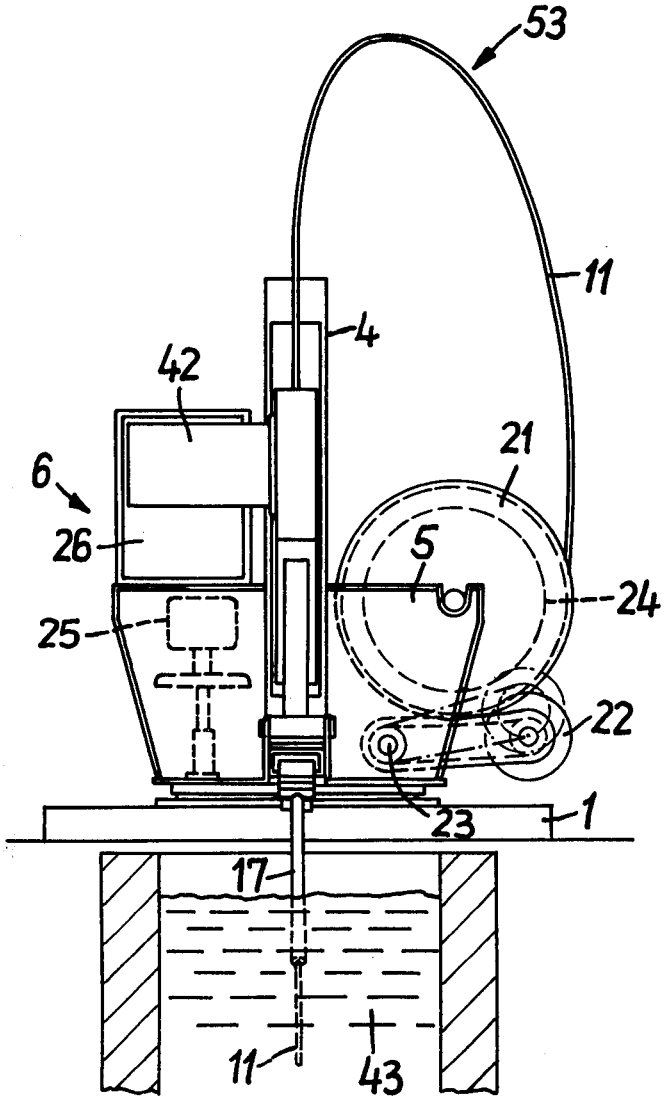
FIG. 2 is a front view of the charging device according to FIG. 1.

The clamping and loosening device 16 has a stationary clamping jaw 51 opposite to which is located a displaceable clamping jaw 52 which is mechanically automatically connected with the displaceable cutting blade 13. The operation of the charging device is as follows. In the starting position, the housing 2 is turned by 90° counter to the illustration in FIG. 1. The boom 9 occupies the dot-dash line upper position shown in FIG. 1.

The cardboard sleeve 17 is by an operator inserted into the clamping device 16. A controlling device of the power operable device 12 displaces the clamping jaw 52 against the pressure of the leaf spring 48. The cardboard sleeve 17 is inserted into the thus formed opening. After the power operable device 12 has been freed, the clamping jaw 52 moves by means of the leaf spring 48 against the cardboard sleeve 17 and clamps the same fast. The aluminum wire 11 is with a wide arc 53 from reel 21 introduced into the upper guiding groove rolls 36 and the driving grooved rolls 35. The wide arc 52 of the aluminum wire 11 also brings about a compensation during a displacement of the boom 9.

The housing 2 is by means of the motor driving unit 19 pivoted above the steel melt 43. The boom 9 is moved quickly into its lower end position shown in FIG. 1 so that the cardboard sleeve 17 immerses by about 2/3 of its length in the steel melt 43. As soon as the lower end position has been reached, the electric motor 23 for the driving rolls 22 and the electric motor driving unit 7 for the driving grooved rolls 35 are turned on. The turning on is effected by means of a control device which ascertains the lower end position of the boom 9, or by an operator. The aluminum wire 11 extends through the cardboard sleeve 17 and immerses into the steel melt 43. The transporting speed can be so controlled that the melting-off operation of the aluminum wire 11 is effected only shortly prior to reaching the bottom of the crucible. The wire length is ascertained by means of a rotation counter 54 which is located in driving grooved roll 35. A signalling of the wire length predetermined for a charge brings about a turning-off of the electric motor 23 and of the electric motor driving unit 37.

A nearly uniform circumferential speed at variable winding diameters is assured by the constant driving roll 22 which drives the reel 21 at the mantle surface of the aluminum wire coil 24. The circumferential speed of the driving grooved rolls 35 is predetermined and thus also the main circumferential speed. During a charging cycle, the reel 21 will pre-timed unit feed the same wire length whereas the driving grooved rolls 35 will per timed unit feed a different wire length. The second arc 53 also exerts a compensating function.

After the electric motor 23 and the electric motor driving unit 37 have been turned off, the aluminum wire 31 is cut off by the wire shearing device 15. Due to the mechanical connection of the displaceable cutting blade 13 with the clamping jaw 52, the clamping and loosening device 16 will be opened. The cardboard sleeve 17 and the lower remaining length of the aluminum wire 11 drop into the steel melt 43. In this connection, the cardboard sleeve 17 burns in the steel melt 43. The boom 9 is moved into the upper end position indicated in FIG. 1 by a dot-dash line, and the motor driving unit 13 turns the housing back to its starting position.

It is, of course, to be understood that the present invention is, by no means, limited to the specific showing in the drawings, but also comprises any modifications within the scope of the appended claims.

What is claimed is:

1. A device for supplying charge material in the form of wire to a metal melt which comprises; a frame, a feed pipe in the frame extending into the melt from above, feed means carried by the frame and operable for withdrawing the charge material from a supply thereof and for feeding the material into said feed tube at the upper end thereof, the supply of charge material including means in said frame for rotatably supporting a reel of the material, a rotary drive member engaging the surface of the material wound on said reel, and means for driving said drive member in rotation.

2. A device for supplying charge material in the form of wire to a metal melt which comprises; a frame, a feed pipe in the frame extending into the melt from above, and feed means carried by the frame and operable for withdrawing the charge material from a supply thereof and for feeding the material into said feed tube at the upper end thereof, said feed means comprising a plurality of pairs of gripper rollers adapted to receive the wire therebetween and a box-like boom in which said pairs of feed rollers are mounted, said boom being movable on said frame in the direction of movement of the wire through said gripper roller.

3. A device according to claim 2 in which one roller of at least one pair is rotatably supported on a lever pivoted in said boom near the axis of rotation of the other roller of the said one pair, and spring means acting on said lever to cause said one roller to press on the wire.

4. A device according to claim 2 in which the wire has a large loop or arc formed therein between the reel and the point of entry of the wire into said gripper rollers.

5. A device according to claim 2 which includes guide rod means in said frame on which said boom is slidable and power means in the frame connected to said boom for movement thereof on the frame.

6. A device according to claim 2 which includes an endless metal band in said frame, said boom being connected to said band, and spring loaded roller means in said frame supporting said band.

7. A device for supplying charge material in the form of wire to a metal melt which comprises; a frame, a feed pipe in the frame extending into the melt from above, feed means carried by the frame and operable for withdrawing the charge material from a supply thereof and for feeding the material into said feed tube at the upper end thereof, said feed tube being interrupted in a region spaced above the melt surface, a cutter in the frame operable to cut off the wire in said region, a clamp device for supporting the lower end of said feed tube prior to cutting off of the wire, and means for releasing said clamp device after cut off of the wire to drop the lower end of the feed tube into the melt together with the cut off wire therein.

8. A device according to claim 7 in which the lower end of the feed tube is combustible material.

9. A device according to claim 7 which includes power means for actuating said cutter, said power means also actuating said clamp device.

* * * * *